United States Patent [19]

Geberth, Jr.

[11] Patent Number: 4,508,268

[45] Date of Patent: Apr. 2, 1985

[54] REVERSIBLE SPRAY TIP

[76] Inventor: John D. Geberth, Jr., 10 Goose Cove La., Ramsey, N.J. 07446

[21] Appl. No.: 451,926

[22] Filed: Dec. 21, 1982

[51] Int. Cl.[3] ..... B05B 15/02
[52] U.S. Cl. ..... 239/119; 239/600
[58] Field of Search ..... 239/119, 525, 526, 600

[56] References Cited

U.S. PATENT DOCUMENTS

| | | | |
|---|---|---|---|
| 3,202,360 | 8/1965 | O'Brien | 239/119 |
| 3,831,862 | 8/1974 | Calder | 239/526 |
| 4,116,386 | 9/1978 | Calder | 239/119 |
| 4,165,836 | 8/1979 | Eull | 239/119 |

FOREIGN PATENT DOCUMENTS

| | | | |
|---|---|---|---|
| 2079184 | 1/1982 | United Kingdom | 239/119 |

*Primary Examiner*—Jeffrey V. Nase
*Assistant Examiner*—Michael J. Forman
*Attorney, Agent, or Firm*—Collard, Roe & Galgano

[57] ABSTRACT

A reversible spray tip or nozzle is provided for use with spray guns and like devices adapted to hydraulically atomize and spray liquids such as paint comprising a housing, a removable rotatable member transversely located in said housing having a transverse fluid bore terminating in a spray opening, and a sealing member in said housing slideably and releasably engaging the rotatable member and having a fluid passageway therethrough communicating between the fluid bore in the rotatable member and the source of high pressure liquid supplied to the spray gun or like device.

28 Claims, 7 Drawing Figures

REVERSIBLE SPRAY TIP

The present invention relates generally to spray guns and like devices for hydraulically atomizing and spraying liquids such as paint and, more particularly, it relates to such spray guns and like devices wherein the spray tip or nozzle is reversible so that obstructions wherein which clog the nozzle may be easily removed by the reversed flow of the high pressure liquid therethrough.

A disadvantage inherent in hydraulic paint spraying, wherein paint under high pressure is supplied to a spray gun or similar device and forced through a spray tip or nozzle having a spray opening, is clogging. Because of the nature of this method of paint spraying, it is necessary that the fluid passaageway and spray opening in the spray tip be very small so that the paint or other liquid as it reaches the spray tip under high pressure and with low velocity is accelerated through the spray opening to a high velocity and low pressure thereby forming a fan spray. However, because of the small size of the spray opening and fluid passageway leading thereto, the spray tip is susceptible to clogging with particles carried in the fluid being sprayed.

One relatively simple method of overcoming this disadvantage has been to provide means whereby the spray tip is reversed relative to the fluid flow so that the spray opening faces the high pressure fluid. This permits the fluid to flow through the spray tip or nozzle in a direction opposite to its normal flow thereby dislodging the particles or particles causing the blockage. Examples of devices utilizing this method can be found in U.S. Pat. No. 3,202,360, to O'Brien, granted Aug. 24, 1965, U.S. Pat. No. 3,831,862, to Calder, granted Aug. 27, 1974, and U.S. Pat. No. 4,165,836, to Eull, granted Aug. 28, 1979. In the first cited patent, that granted to O'Brien, a reversible spray tip is described wherein the tip is mounted in a diametric bore in a transverse cylinder which may be rotated in its housing to present the spray tip forwardly for spraying or in the reversed position so that the spray tip faces the high pressure liquid. A packing sleeve, possibly formed of a plastic material, is positioned on the upstream side of the rotatable cylinder in complimentary abutting relationship to the cylinder. On the upstream side of the packing sleeve a resilient ring is provided so that when the tip is secured to the spray gun, pressure is maintained between the packing sleeve and the cylinder thus providing a seal therebetween. The cylinder is maintained in its rotatable position within the housing by being mounted in a cylindrically shaped transverse bore, one end of which is open to accept the cylinder and the other end closed except for a smaller central opening through which a hub on an end of the cylinder extends. This hub is then engaged by a handle for rotating the cylinder and for preventing dislodgement of the cylinder in the bore.

The spray nozzle described in the Eull patent is very similar in construction and operation to the device in the O'Brien patent. The major point of departure is the provision in the Eull patent of a safety guard which additionally provides means for securing the rotatable cylinder within the spray nozzle housing. Thus, the safe use of the spray nozzle is enhanced since removal of the safety guard results in the dismantling of the rotatable spray nozzle. The cylinder, containing the spray tip, is secured within its housing by the provision of a screw means which threadably engages the safety guard and one end of the cylinder. The handle for rotating the cylinder is engaged by key means at the other end of the cylinder and is also retained in position by the safety guard.

The spray nozzle described in the Calder patent varies from the two previously discussed in that a cylindrical member is provided with an axial fluid passageway terminating in a spray tip with the cylindrical member positioned axially in the spray nozzle housing. The cylindrical member is axially removable from the housing and may be reversed therein to present the spray tip to the pressure of the fluid to thereby dislodge any clogging matter. In order to maintain or secure the cylindrical member within the housing, a bolt is provided diametrically extending from the cylinder which is engaged by a slot in the housing.

The primary object of the present invention is to provide a reversible spray tip for a spray gun or like device, adapted to hydraulically atomize and spray liquids such as paint, which is simpler in design, easier to manufacture and simpler to utilize than reversible spray tips heretofore available.

The above object, as well as others which will hereinafter become apparent, is accomplished in accordance with the present invention by the provision of a reversible spray tip having a cylindrically shaped rotatable member with a diametrically transverse fluid bore therein terminating in a spray opening, a housing for accepting said member transversely therein, a resilient sealing member within said housing in complimentary abutting engagement with the cylindrical member permitting rotation but not transverse movement thereof, and means for securing the housing to the spray gun and causing said sealing member to effect sealing and engagement with said rotatable member. Release of the securing means relieves engagement between the sealing member and the cylindrical member thus permitting transverse movement of the cylindrical member and removal from the housing.

The present invention will be described and understood more readily when considered together with the accompanying drawings, in which.

Figure 1:
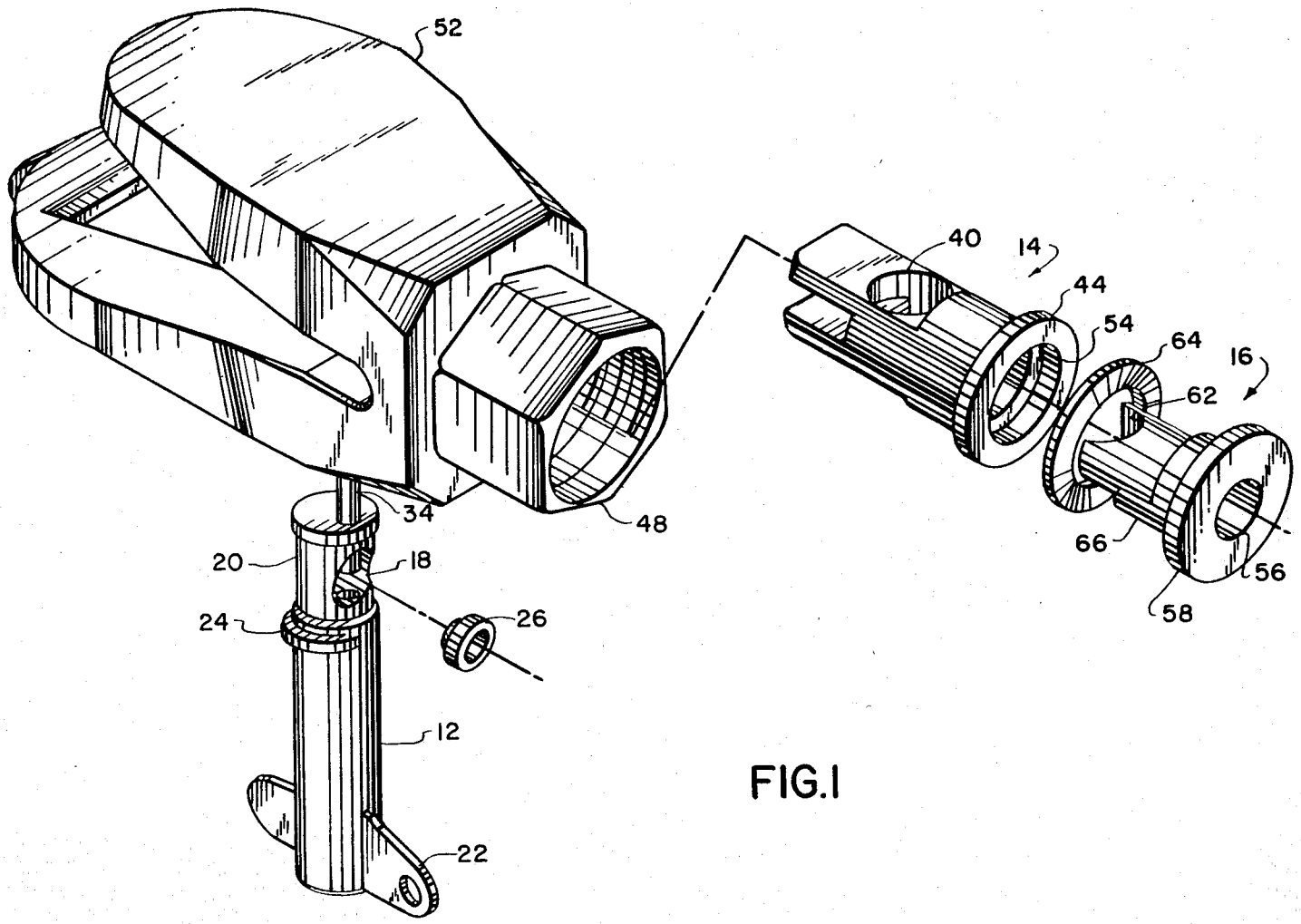
FIG. 1 is an exploded perspective view of the reversible spray tip of the present invention shown together with a safety guard.
Figure 2:
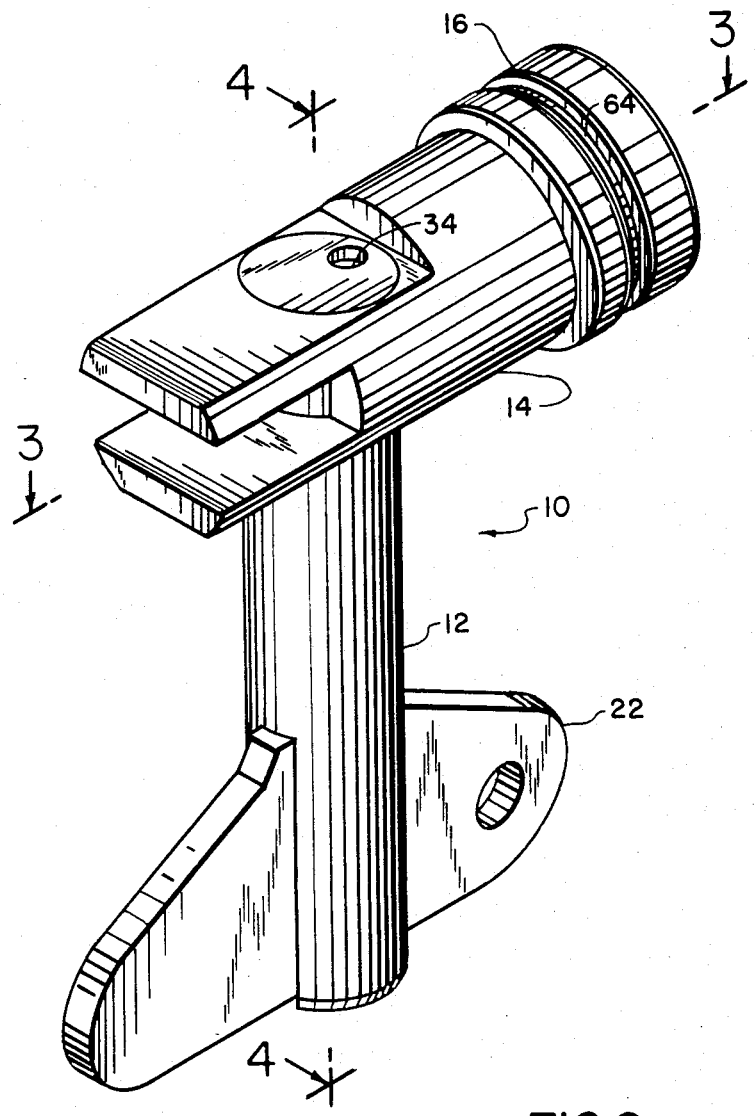
FIG. 2 is a perspective view of the reversible spray tip of the present invention shown assembled.

Referring now to the drawings, there is shown in FIG. 2 a reversible spray tip, generally designated 10, for use with a spray gun or like device adapted to hydraulically atomize and spray liquids such as paint. Spray tip 10 includes a cylindrically shaped member, generally designated 12, a spray tip housing, generally designated 14, and a sealing member, generally designated 16. As clearly seen in FIGS. 1, 3 and 4, cylindrically shaped member 12 is provided with a diametric transverse bore, designated 18, a circumferential undercut portion encompassing bore 18, designated 20, a key handle, designated 22, and a positioning tab, designated 24, extending partially about the circumference of cylindrical member 12.

Transverse bore 18 has press fitted therein a spray tip insert, designated 26, having a fluid bore 28 axially aligned with bore 18 and terminating in a spray opening 30. Preferably, tip insert 26 is formed of a very hard material, such as tungsten carbide, so that premature wear of spray opening 30 does not occur. Tip insert 26 is so positioned within bore 18 that spray opening 30 thereof is located at one end, designated 32, of bore 18 while a diffuser pin, designated 34, is transversely positioned in bore 36 at the end, designated 38, of bore 18 opposite end 32.

Figure 3:
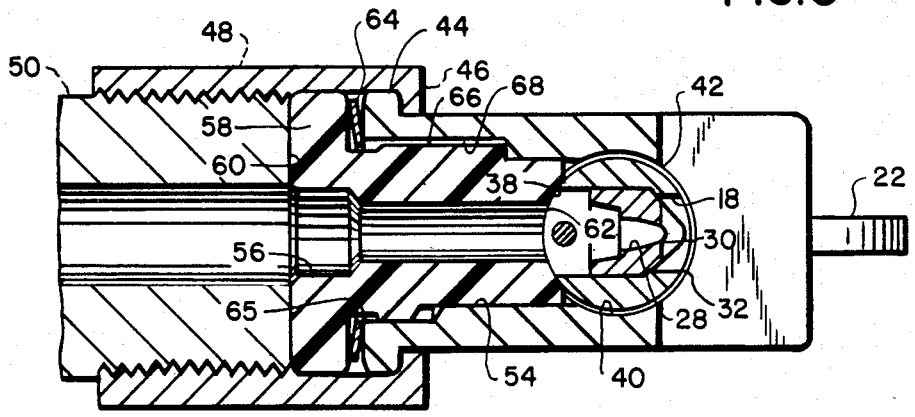
FIG. 3 is a cross-sectional view of the reversible spray tip taken along line 3—3 of FIG. 2 showing its securement to a spray gun.
Figure 4:
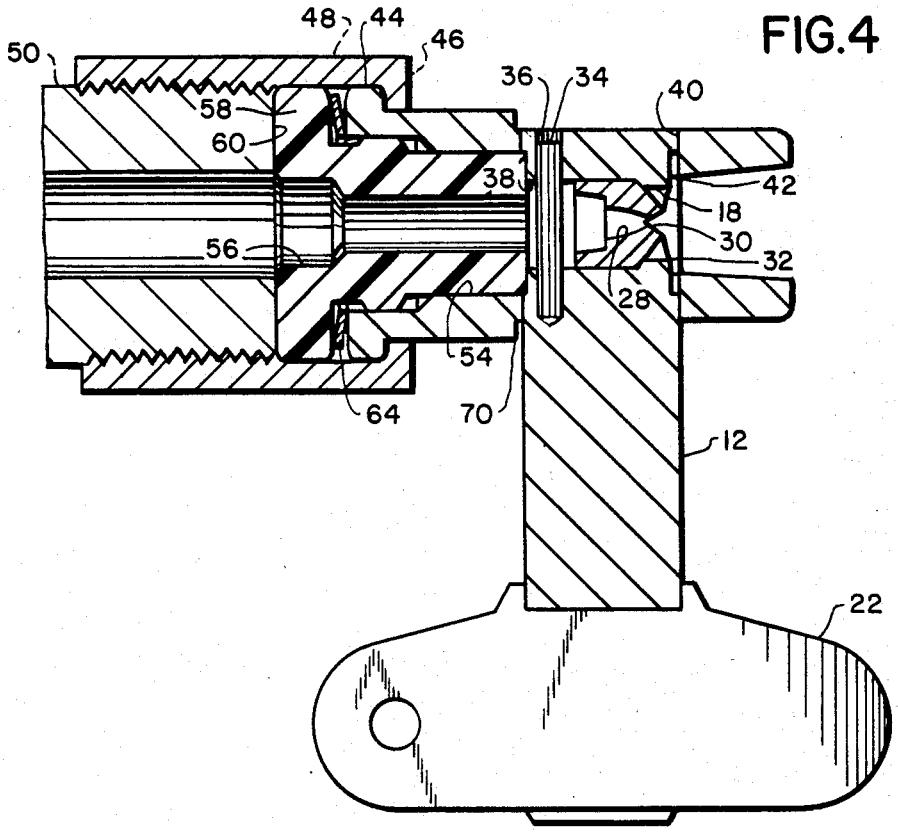
FIG. 4 is a cross-sectional view of the reversible spray tip taken along line 4—4 of FIG. 2 showing its securement to a spray gun.

Near the outlet end of spray tip housing 14 there is provided a cylindrically shaped transverse bore, designated 40, for accepting for rotational movement cylindrical member 12. This outlet end of housing 14 is also provided with an aperture, designated 42, into bore 40 which substantially coincides with bore 18 of cylindrical member 12. A flange, designated 44, is provided at the other or inlet end of housing 14 for engagement by a complimentary flange, designated 46, of securing nut 48 when the spray tip is mounted to a spray gun, designated 50, as seen in FIGS. 3 and 4. As seen in FIG. 1, securing nut 48 may have attached thereto a safety guard, designated 52, which extends forwardly from the spray tip for the purpose of preventing accidental injection of the fluid into an operator or on-looker.

An axial bore, designated 54, is provided at the inlet end of housing 14 and is adapted to accept sealing member 16 therein. Axial bore 54 extends to and intersects transverse bore 40. Sealing member 16, which is preferably formed of a resilient, solvent resistant material such as the plastic delrin, is provided with an axial fluid bore 56 which communicates at its inlet end with the source of high pressure liquid supplied to the spray gun, as clearly seen in FIGS. 3 and 4. The outlet end of fluid bore 56 communicates with diametric bore 18 of cylindrical member 12 thereby providing an unobstructed fluid passageway for the high pressure liquid between the spray gun and spray opening 30. At the inlet side of sealing member 16, a sealing flange or washer, designated 58, is adapted to be disposed between flange 44 of housing 14 and the outlet face, designated 60, of the spray gun. The forward or outlet face, designated 62, of sealing member 16 is adapted to be in complimentary abutting relationship with cylindrical member 12. Thus, face 62 of sealing member 16 is provided with a concave surface matching the cylindrical shape of member 12. Furthermore, the height of sealing member 16 at face 62, measured in the axial direction of cylindrical member 12, coincides with undercut portion 20 of member 12 so that face 62 of sealing member 16 mates with the undercut surface.

A spring washer, designated 64, is disposed between sealing flange 58 of sealing member 16 and flange 44 of housing 14 for the purpose of biasing housing 14 away from sealing flange 58. Washer 64 way be retained on sealing member 16 by the provision of an annular groove, designated 65, in sealing member 16 adjacent flange 58.

Preferably, bore 54 and sealing member 16 are circular in shape and for the purpose of aligning the two easily a key arrangement is provided. Thus, as clearly seen in FIG. 1, sealing member 16 has a key, designated 66, extending axially along part of its length which mates with a corresponding keyway, designated 68, in bore 54 of housing 14 as clearly seen in FIG. 3.

Figure 5:
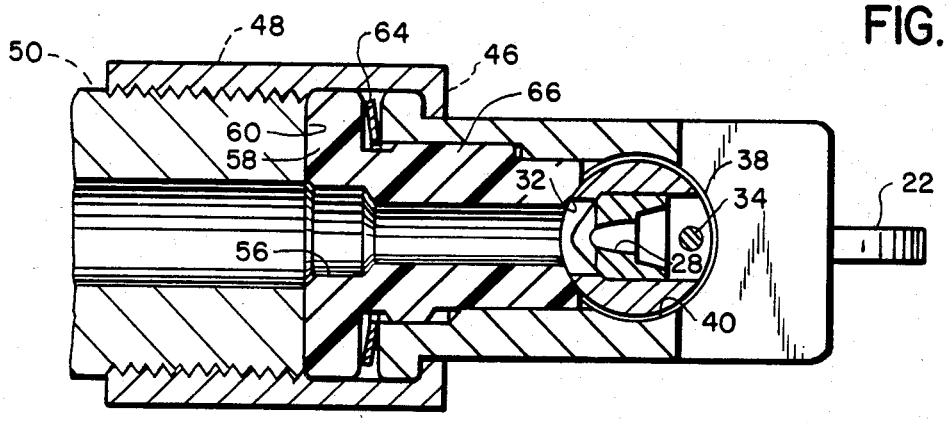
FIG. 5 is a cross-sectional view of the reversible spray tip similar to FIG. 3 shown in the reversed position.
Figure 6:
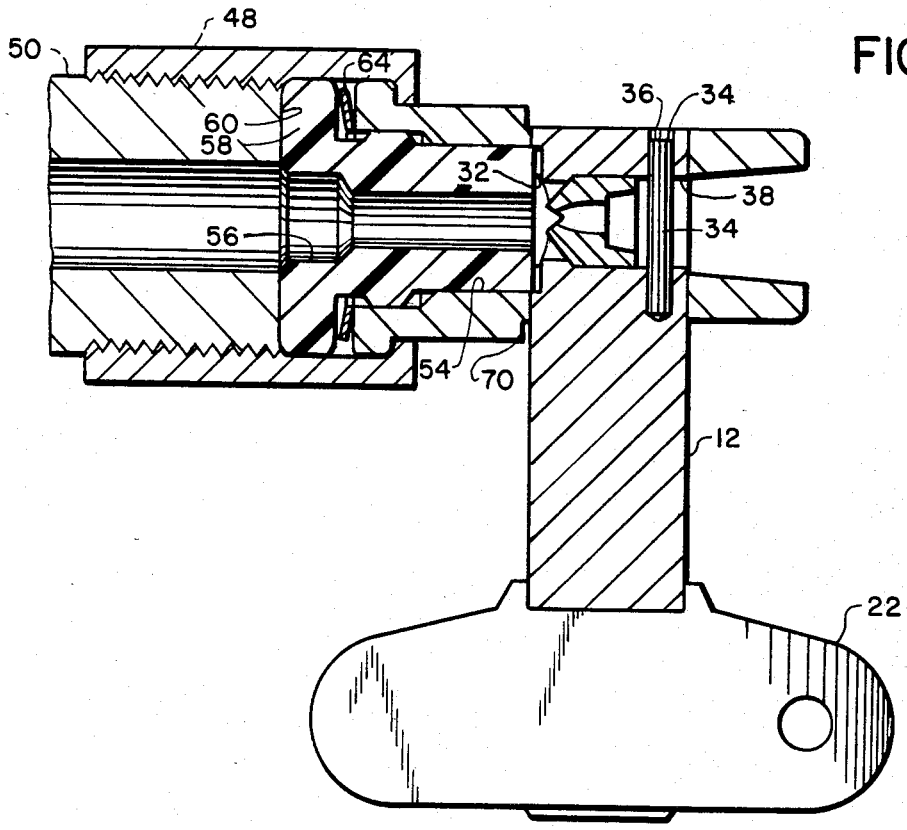
FIG. 6 is a cross-sectional view of the reversible spray tip similar to FIG. 4 shown in the reversed position.

Positioning tab 24 of cylindrical member 12 is adapted to engage with a rotational stop, designated 70, on housing 14 such that cylindrical member 12 may be rotated between two positions one hundred eighty degrees apart. Thus, cylindrical member 12 may be positioned as shown in FIGS. 3 and 4 with spray opening 30 facing forward for spraying or it may be rotated one hundred eighty degrees so that spray opening 30 is reversed as shown in FIGS. 5 and 6.

Figure 7:
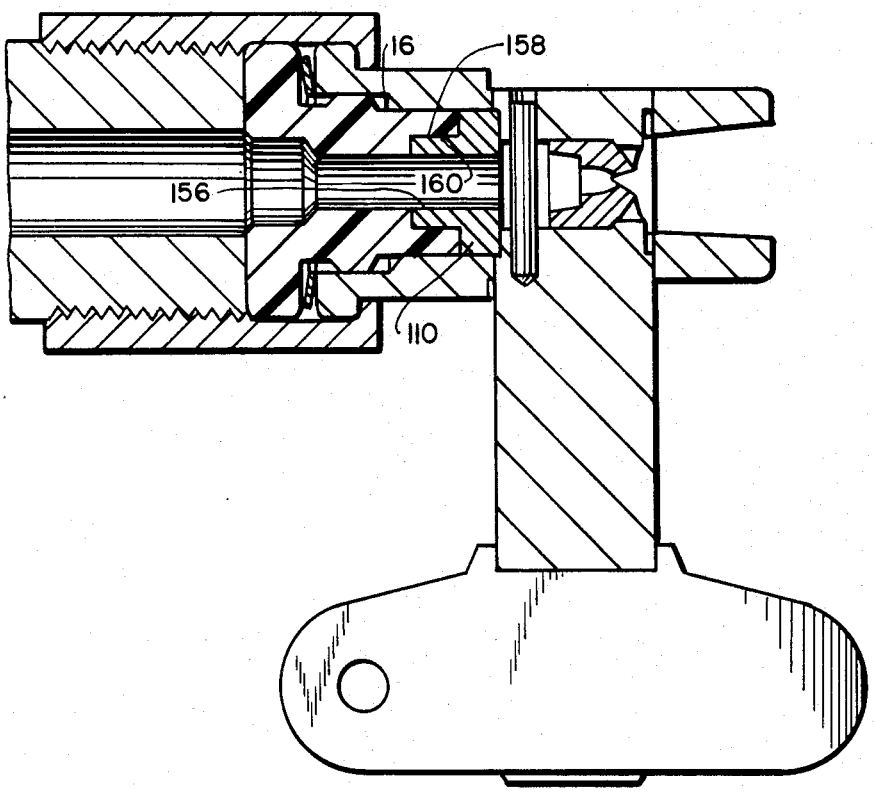
FIG. 7 is a cross-sectional view of another embodiment of the reversible spray tip.

It is preferable for ease of rotation of cylindrical member 12 that sealing member 16 be formed of a solvent resistant plastic material while cylindrically shaped member 12 is formed of hard metal such as steel. However, as seen in the embodiment of FIG. 7, it is also possible to provide the front end of sealing member 16 with an insert, designated 110, formed of a hard material such as steel, tungsten carbide, ceramic, etc. Insert 110 has an axial fluid bore, designated 156, which is axially aligned with fluid bore 56 of sealing member 16. An annular collar, designated 158, is provided at the inlet side of insert 110 which is press fitted into a complimentary annular recess, designated 160, in sealing member 16 for the purpose of attaching insert 110 to sealing member 16. In all other respects, the embodiment of the spray tip shown in FIG. 7 is identical to that shown and described in FIGS. 1 to 6.

In operation, when assembling reversible spray tip 10, securing nut 48 having safety guard 52 attached thereto is first positioned over spray tip housing 14. Next, cylindrical member 12, having tip insert 26 mounted in bore 18, is inserted into bore 40 of spray tip housing 14 while sealing member 16 having spring washer 64 mounted thereon is inserted into axial bore 54 of housing 14 with key 66 aligned with keyway 68. When thus assembled, forward face 62 of sealing member 16 engages with undercut portion 20 of cylindrical member 12. Assembled spray tip 10 is then mounted onto a spray gun by means of securing nut 48. Tightening of securing nut 48 causes the compression of spray washer 64 resulting in forward face 62 of sealing member 16 being forced against cylindrical member 12 at undercut portion 20. This engagement between forward face 62 of sealing member 16 and undercut portion 20 prevents the transverse movement of cylindrical member 12 and hence the disassembly of spray tip 10. Because of the engagement of positioning tab 24 with rotational stop 70 cylindrical member 12 may be rotated through one hundred eighty degrees. The relative positioning of positioning tab 24 vis à vis diametric bore 18 permits the alignment in either direction of bore 18 with axial fluid bore 56 of sealing member 16 when positioning tab 24 engages with rotational stop 70. Thus, tip insert 26 may be located forwardly as in FIGS. 3 and 4 in one position of cylindrical member 12 or it may be located rearwardly as in FIGS. 5 and 6 in the second position of cylindrical member 12. When tip insert 26 is in its forward position, spray tip 10 is adapted for spraying and is thus used. When clogging of spray opening 30 occurs and it is desired to clear the spray tip, cylindrical member 12 is rotated by the grasping and turning of key handle 22 to present tip insert 26 rearwardly, facing the high pressure fluid bore 56. Thus, when the spray gun is actuated, the high pressure fluid forces the dislodgement of the clogging matter which is pushed through fluid bore 28 of tip insert 26 in a reversed flow therethrough. Diffuser pin 34 serves to diffuse the stream of fluid passing through tip insert 26 in this reversed manner so that the fluid exiting the spray tip does not do so in a concentrated stream which could cause injury. In order to remove cylindrical member 12 from the spray tip, it is merely necessary to relieve the tension on spring washer 64 by unscrewing securing nut 48 sufficiently. This relieves the pressure exerted by sealing member 16 on undercut portion 20 allowing movement therebetween so that cylindrical member 12 may be withdrawn from spray tip housing 14.

It is to be understood that the foregoing general and detailed descriptions are explanatory of the present invention and are not to be interpreted as restrictive of the scope of the following claims.

What is claimed is:

1. A spray nozzle for use with a spray device adapted for hydraulically atomizing and spraying liquids, the spray device having a fluid passageway communicating with conduit means connected to a source of liquid under pressure, said spray nozzle including:

a. a housing, having a first axial bore therethrough and a second cylindrically shaped bore transverse thereto;

b. a cylindrical member transversely mounted for rotational movement in said cylindrically shaped transverse bore of said housing, said cylindrical member having a diametric bore therethrough terminating in a spray opening;

c. a sealing member in said first axial bore of said housing having an axial fluid bore therethrough communicating between the fluid passageway of said spray device and the diametric bore in said cylindrical member, the outlet end of said sealing member having a shape complimentary to and in abutting relationship with said cylindrical member;

d. means engaging said sealing member with said cylindrical member to prevent transverse movement of said cylindrical member in said housing;

e. means for securing said nozzle to said spray device and effecting sealing therebetween; and f. means for rotating said cylindrical member.

2. The spray nozzle of claim 1 which further includes stop means to permit one hundred eighty degree rotational movement of said cylindrical member whereby the spray opening in the diametric bore in said cylindrical member may be presented forwardly or rotated to a reversed position by the rotation of said cylindrical member.

3. The spray nozzle of claim 1 wherein said sealing member is formed of a resilient solvent resistant material.

4. The spray nozzle of claim 3 wherein said cylindrical member is formed of hard metal.

5. The spray nozzle of claim 4 wherein the downstream end of said sealing member is formed of a hard material.

6. The spray nozzle of claim 5 wherein the downstream end of said sealing member is formed of tungsten carbide.

7. The spray nozzle of claim 5 wherein the downstream end of said sealing member is formed of ceramic.

8. The spray nozzle of claim 5 wherein the downstream end of said sealing member is formed of hardened steel.

9. The spray nozzle of claim 1 wherein the means engaging said sealing member with said cylindrical member includes an annular undercut provided in said cylindrical member which mates with the complimentarily shaped outlet end of said sealing member thereby preventing transverse movement of said cylindrical member.

10. The spray nozzle of claim 9 which further includes means biasing said cylindrical member from said sealing member to permit transverse movement of said cylindrical member and removal thereof from said transverse bore, said biasing means being overcome by said securing means when said nozzle is secured to said spray device and sealing therebetween effected.

11. The spray nozzle of claim 10 wherein said sealing member includes a sealing washer at its inlet end disposed between said spray device and said spray nozzle housing.

12. The spray nozzle of claim 11 wherein said biasing means includes a spring washer disposed between said sealing washer of said sealing member and said spray nozzle housing.

13. The spray nozzle of claim 1 which further includes means for aligning said sealing member within said first axial bore of said housing whereby the outlet end thereof is always presented in complimentary relationship with said cylindrical member.

14. The spray nozzle of claim 13 wherein said sealing member is cylindrical in shape and said aligning means includes a keyway in said first axial bore in said housing which mates with a key in the cylindrical surface of said sealing member.

15. In a reversible spray nozzle of the type used with a spray device adapted for hydraulically atomizing and spraying liquids, the spray device having a fluid passageway communicating with conduit means connected to a source of liquid under pressure, the spray nozzle including a housing having a first axial bore therethrough and a second cylindrically shaped bore transverse thereto, a cylindrical member transversely mounted for rotational movement in said cylindrically shaped transverse bore of said housing, said cylindrical member having a diametric bore therethrough terminating in a spray opening, a sealing member in said first axial bore of said housing having an axial fluid bore therethrough communicating between the fluid passageway of said spray device and the diametric bore in said cylindrical member, the outlet end of said sealing member having a shape complimentary to and in abutting relationship with said cylindrical member, means for securing said spray nozzle to said spray device, and means for rotating said cylindrical member, the improvement comprising means engaging said sealing member with said cylindrical member to prevent transverse movement of said cylindrical member in said nozzle housing.

16. The spray nozzle of claim 15 which further includes stop means to permit one hundred eighty degree rotational movement of said cylindrical member whereby the spray opening in the diametric bore in said cylindrical member may be presented forwardly or rotated to a reversed position by the rotation of said cylindrical member.

17. The spray nozzle of claim 15 wherein said sealing member is formed of a resilient solvent resistant material.

18. The spray nozzle of claim 17 wherein said cylindrical member is formed of hard metal.

19. The spray nozzle of claim 18 wherein the downstream end of said sealing member is formed of a hard material.

20. The spray nozzle of claim 19 wherein the downstream end of said sealing member is formed of tungsten carbide.

21. The spray nozzle of claim 19 wherein the downstream end of said sealing member is formed of ceramic.

22. The spray nozzle of claim 19 wherein the downstream end of said sealing member is formed of hardened steel.

23. The spray nozzle of claim 19 which further includes means for aligning said sealing member within said first axial bore of said housing whereby the outlet end thereof is always presented in complimentary relationship with said cylindrical member.

24. The spray nozzle of claim 23 wherein said sealing member is cylindrical in shape and said aligning means includes a keyway in said first axial bore in said housing which mates with a key in the cylindrical surface of said sealing member.

25. The spray nozzle of claim 15 wherein the means engaging said sealing member with said cylindrical member includes an annular undercut provided in said cylindrical member which mates with the complimentarily shaped outlet end of said sealing member thereby preventing transverse movement of said cylindrical member.

26. The spray nozzle of claim 25 which further includes means biasing said cylindrical member from said sealing member to permit transverse movement of said cylindrical member and removal thereof from said transverse bore, said biasing means being overcome by said securing means when said nozzle is secured to said spray device and sealing therebetween effected.

27. The spray nozzle of claim 26 wherein said sealing member includes a sealing washer at its inlet end disposed between said spray device and said spray nozzle housing.

28. The spray nozzle of claim 27 wherein said biasing means includes a spring washer disposed between said sealing washer of said sealing member and said spray nozzle housing.

* * * * *